US005109782A

United States Patent [19]

Uyama

[11] Patent Number: 5,109,782

[45] Date of Patent: May 5, 1992

[54] COVER PLATE AND BOBBIN HOLDER THREAD TENSIONING GUIDES

[75] Inventor: Yoshiyuki Uyama, Nagoya, Japan

[73] Assignee: Brother Koygo Kabushiki Kaisha, Nagoya, Japan

[21] Appl. No.: 583,328

[22] Filed: Sep. 17, 1990

[30] Foreign Application Priority Data

Oct. 23, 1989 [JP] Japan ..... 1-275374

[51] Int. Cl.[5] ..... D05B 57/14

[52] U.S. Cl. ..... 112/184; 112/229

[58] Field of Search ..... 112/184, 196, 227, 229, 112/232, 233, 254, 260, 279, 302, 310

[56] References Cited

U.S. PATENT DOCUMENTS

| | | | |
|---|---|---|---|
| 2,136,288 | 11/1938 | Ebert | 112/260 |
| 3,381,642 | 5/1968 | Bono | 112/233 X |
| 3,570,429 | 3/1971 | Bolt et al. | 112/233 |
| 4,397,250 | 8/1983 | Zylbert et al. | 112/184 |
| 4,413,579 | 11/1983 | Johnson | 112/184 |
| 4,429,649 | 2/1984 | Eguchi et al. | 112/233 X |
| 4,437,421 | 3/1984 | Johnson | 112/184 X |
| 4,542,706 | 9/1985 | Hanyu et al. | 112/231 X |
| 4,601,250 | 7/1986 | Clement | 112/184 |
| 4,674,423 | 6/1987 | Koike et al. | 112/184 |
| 4,693,193 | 9/1987 | Hanyu et al. | 112/184 X |
| 4,694,763 | 9/1987 | Adams | 112/184 |
| 4,748,925 | 6/1988 | Takei et al. | 112/229 X |

*Primary Examiner*—Werner H. Schroeder
*Assistant Examiner*—Ismael Izaguirre
*Attorney, Agent, or Firm*—Oliff & Berridge

[57] ABSTRACT

A bobbin-thread supply device for a sewing machine. The operator inserts the bobbin into the bobbin holder, draws bobbin thread from the bobbin, and passes the tip of the bobbin thread through the slit in the cover above the bobbin holder. Since the slit in the cover extends above where the tension bracket is joined onto the tension spring, the bobbin thread is guided between the tension bracket and the tension spring through the tension regulating portion. The bobbin thread can thus easily be set with appropriately tension applied thereon. At the same time, the length of the bobbin thread can be adjusted for proper sewing operation.

17 Claims, 8 Drawing Sheets

COVER PLATE AND BOBBIN HOLDER THREAD TENSIONING GUIDES

BACKGROUND OF THE INVENTION

This invention relates to a sewing machine with a horizontal rotary hook mechanism, and especially to a bobbin-thread supply mechanism for a sewing machine in which bobbin thread can be easily set.

In household sewing machines, horizontal rotary hook bobbin thread supply mechanisms, without a bobbin case, are replacing vertical rotary hook bobbin thread mechanisms. With the vertical rotary hook bobbin thread supply, an operator places a bobbin in a bobbin case and sets the bobbin case into the vertical rotary hook mechanism. In the horizontal rotary bobbin thread mechanisms, as shown in FIG. 9, a bobbin holder 3 includes a cylindrical container 3*a* below an opening 2 in a needle plate 1. In this mechanism the operator can easily put a bobbin 4 through the opening 2 into the bobbin holder 3.

In the above related art, a tension regulating portion 5 is provided for applying tension to bobbin thread drawn from the bobbin 4. The tension regulating portion 5 includes a tension bracket 6 and a tension spring 7 overlapped in an indentation 3*b* formed along a part of the inner periphery of the cylindrical container 3*a* in the bobbin holder 3, as shown in the lower part of FIG. 9. A notch 6*a*, only an open edge of which is shown in FIG. 9, extends obliquely from the upper edge of the tension bracket 6. When bobbin thread is passed from the notch 6*a* through the tension bracket 6 and the tension spring 7 to a sewing mechanism, the tension bracket 6 and the tension spring 7 apply tension to bobbin thread.

After inserting the bobbin 4 into the bobbin holder 3, the operator should pass the tip of bobbin thread drawn from the bobbin 4 through the tension regulating portion 5. Specifically, the operator should thread the notch 6*a* from its open edge with the tip of bobbin thread. The threading of bobbin thread is troublesome and time-consuming. If the sewing machine operates with bobbin thread being inappropriately passed through the tension regulating portion 5, excessive amount of loose bobbin thread is supplied. When bobbin thread thus differs in tension from needle thread, improper sewing results.

SUMMARY OF THE INVENTION

An object of the invention is to provide a bobbin-thread supply mechanism on a sewing machine that facilitates the setting of bobbin thread.

To attain this and other objects, the present invention provides a bobbin thread supply device for a sewing machine. The bobbin thread supply device comprises a bobbin holder in an arm bed of a sewing machine, a bobbin removably inserted into the bobbin holder, a tension regulating portion in the bobbin holder, a tension bracket in the tension regulating portion, a tension spring fastened onto the tension bracket, and a cover for covering the tension regulating portion. The cover has a slit for guiding bobbin thread toward the portion where the tension bracket and the tension spring overlap each other.

DETAILED DESCRIPTION OF THE PREFERRED EMBODIMENT

Figure 2:
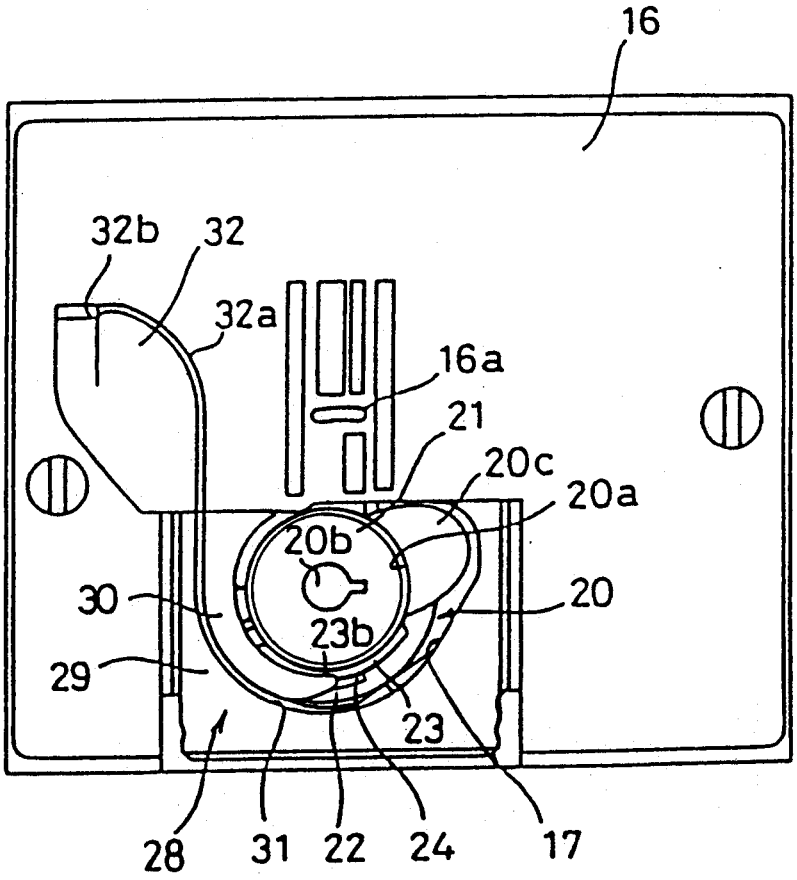
FIG. 2 is a plan view of a needle plate for the embodiment.
Figure 5:
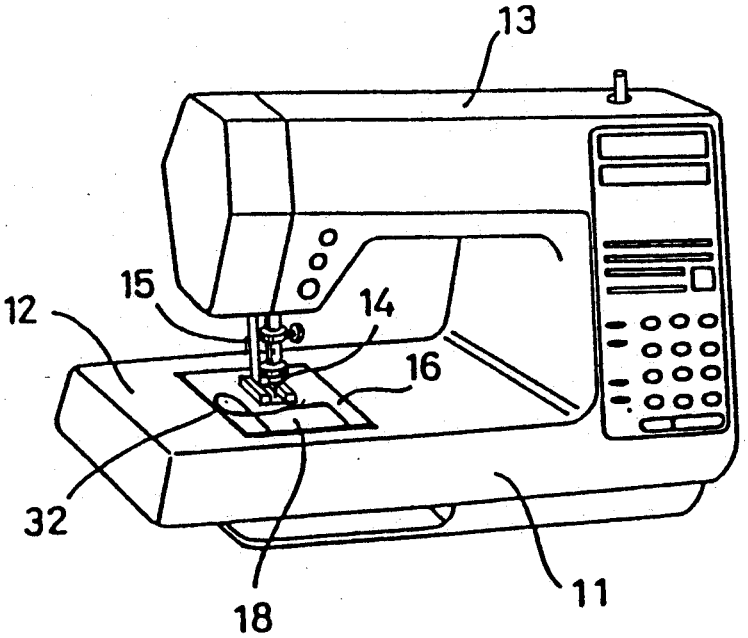
FIG. 5 is a perspective view of the sewing machine on which the embodiment is mounted.

As shown in FIG. 5, an arm bed 11 composes a sewing table 12 and an arm 13 is formed as one piece with the arm bed 11. A needle bar 15 extends from the end of the arm 13 and has a needle 14 on its end. The needle bar 15 moves vertically, driven by a drive mechanism (not shown) for sewing operation. As shown in FIGS. 2 and 5, a needle plate 16 is a metallic plate opposed to the needle bar 15. The needle plate 16 includes a needle hole 16*a* for receiving the needle 14, a rectangular opening 17 in front of the needle hole 16*a* for holding a bobbin 21, and a transparent slide 18 for opening and closing the rectangular opening 17. A feed dog assembly (not shown) is mounted below the needle plate 16 in the arm bed 11 such that the feed dog assembly operates according to the vertical movement of the needle bar 15. A bobbin-thread supply mechanism 19 is also provided below the needle plate 16.

Figure 1:
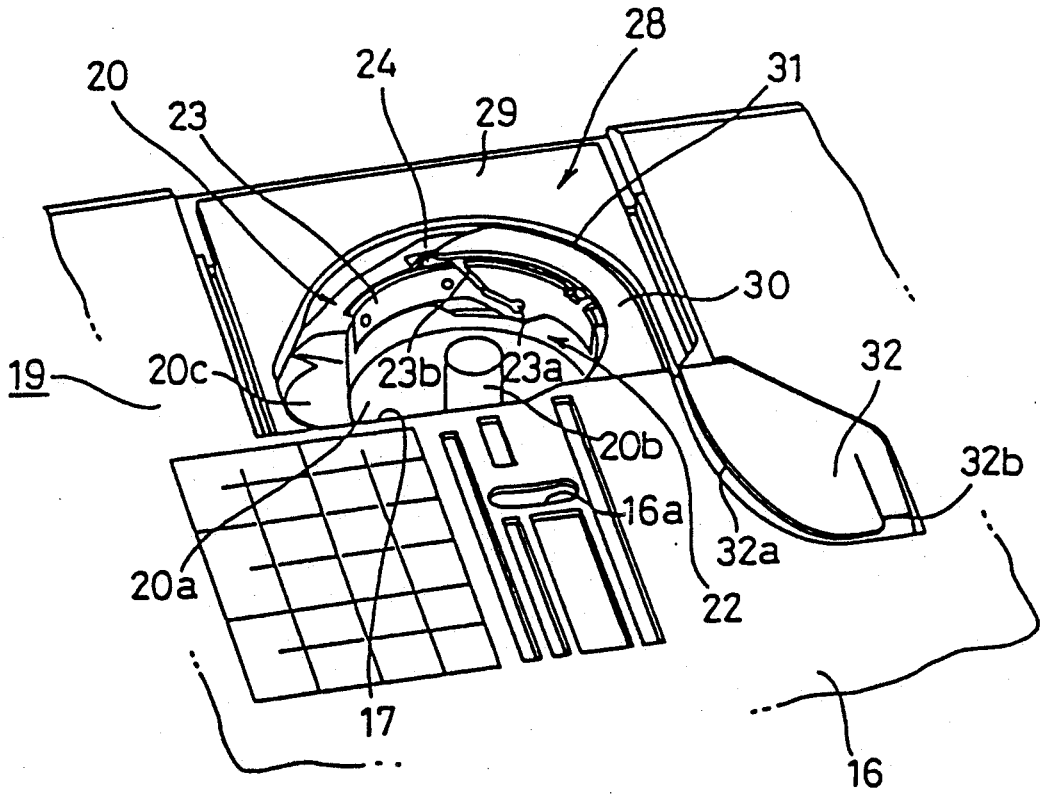
FIG. 1 is a perspective view of an embodiment, seen from the back of a sewing machine.
Figure 3:
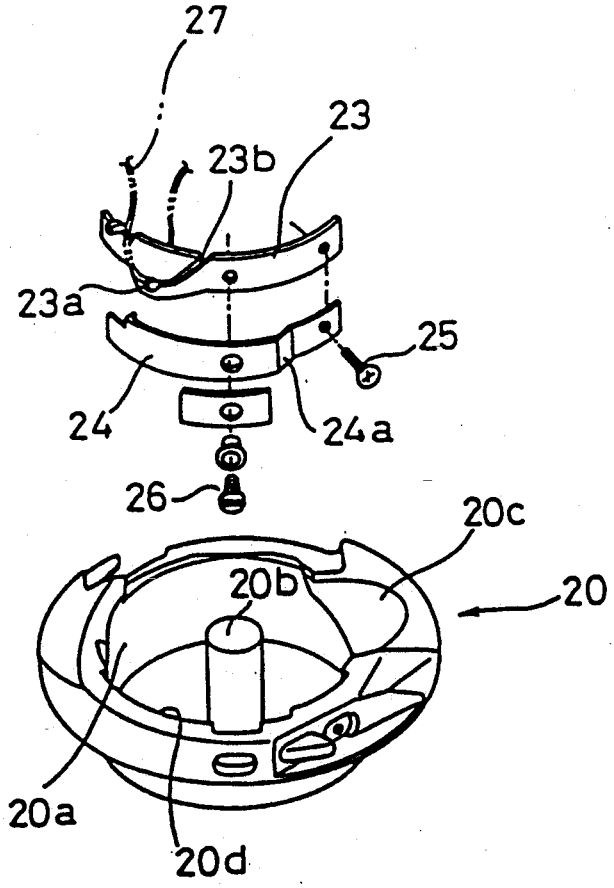
FIG. 3 is a perspective view of a disassembled bobbin holder for the embodiment.
Figure 4:
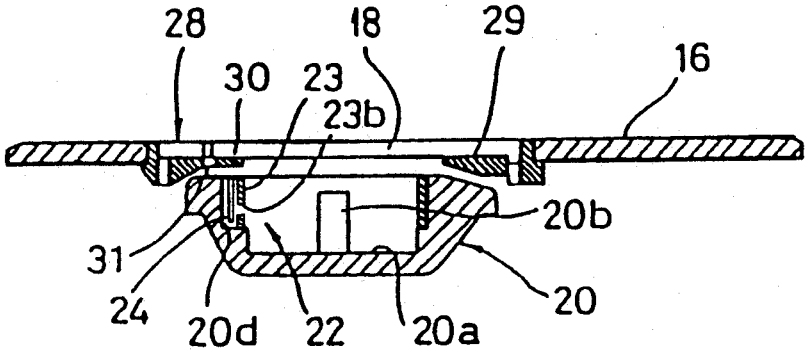
FIG. 4 is a longitudinal section view of the bobbin holder for the embodiment.
Figure 8A:
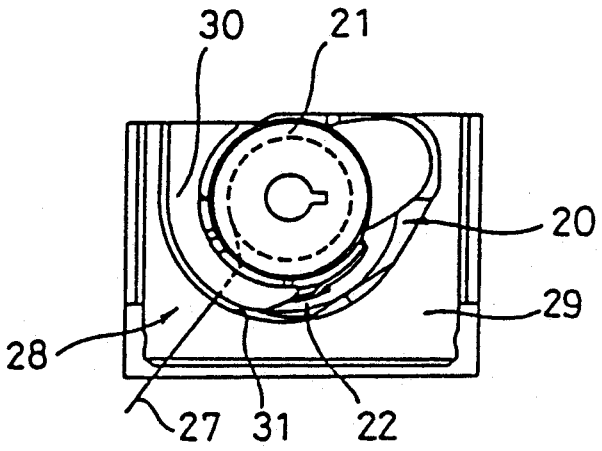
Figure 8B:
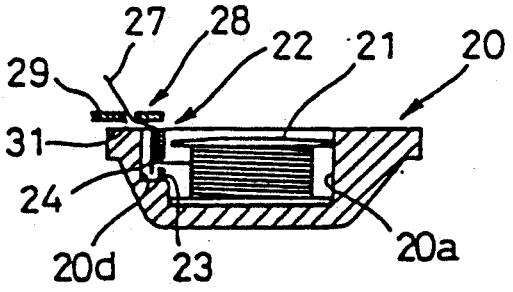

FIGS. 1 and 2 show the rectangular opening 17 with the transparent slide 18 removed therefrom. The bobbin-thread supply mechanism 19 comprises a horizontal rotary hook mechanism below the needle plate 16. The horizontal rotary hook mechanism includes a known rotary hook assembly rotating horizontally in synchronous with the vertical movement of the needle bar 15, and a bobbin holder 20 secured to the arm bed 11. As shown in FIGS. 3 and 4, a container 20*a* forms almost a cylinder in the bobbin holder 20 below the opening 17. As shown in FIG. 2, the bobbin 21 is inserted onto or removed from a stem 20*b* in the container 20*a* through the opening 17 such that the bobbin 21 is rotatable about the stem 20*b*. The bobbin 21 is inserted or removed with a finger tip by an indentation 20*c* in the outer periphery of the container 20*a*. The bobbin holder 20 is provided with a tension regulating portion 22. As shown in FIG. 3, in the tension regulating portion 22, a tension bracket 23 and a tension spring 24 are joined by screws 25 and 26 in an indentation 20*d*. The indentation 20*d* is formed in the inner periphery of the container 20*a* of the bobbin holder 20. The tension bracket 23 and the tension spring 24 have a circular form such that the tension bracket 23 and the tension spring 24 fit along the inner periphery of the container 20*a* of the bobbin holder 20. As shown in FIG. 3, the tension bracket 23 has a pore 23*a* from which a notch 23*b* obliquely extends upward, and the tension spring 24 has a step 24*a*. When the tension spring 24 is attached to the tension bracket 23, the end of the notch 23*b* away from the pore 23*a* of the tension bracket 23 has a little clearance from the opposite portion of the tension spring 24, and the pore 23*a* in the tension bracket 23 closely fits the opposite portion of the tension spring 24. As shown in FIG. 8B, when bobbin thread 27 is drawn from the bobbin 21 and passed from the pore 23*a* through the tension bracket 23 and the tension spring 24 toward the top of the rectangular opening 17, the tension bracket 23 and the tension spring 24 apply tension to the bobbin thread 27. Consequently, when the bobbin thread 27 is passed through the tension regulating portion 22, proper tension is applied to the bobbin thread 27.

As shown in FIG. 1, a cover 28 is provided below the transparent slide 18 such that the cover 28 covers the upper part of the bobbin holder 20 excluding the container 20*a* and the indentation 20*c*. The cover 28 includes a presser plate 29 of plastic attached to the underside of the needle plate 16 above the edge of the outer periphery of the bobbin holder 20 for pressing the bobbin holder 20. The cover 28 also includes a plate 30 forming an arc above the tension regulating portion 22. The arc plate 30 is formed as one piece with the needle plate 16 at one side of the rectangular opening 17, with a little clearance from the inner periphery of the presser plate 29. Therefore, a slit 31 is formed in the cover 28 such that the slit 31 extends along the tension spring 24 overlapped with the tension bracket 23 above the outer periphery of the container 20*a*. As shown in FIG. 1, the end of the arc plate 30 extends beyond the end of the notch 23*b* in the tension bracket 23. The needle plate 16 further includes a thread trimmer 32. The trimmer 32 includes a groove 32*a* with a bottom, formed continuously from the slit 31. The groove 32*a* extends to a knife 32*b*. As described later, after the bobbin thread 27 is drawn from the bobbin 21, the bobbin thread 27 is cut down to the required size in the trimmer 32.

Figure 6A:
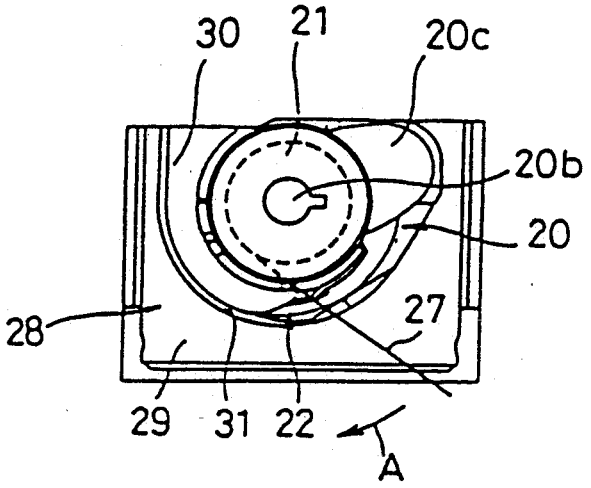
FIGS. 6A, 7A, and 8A are plan views illustrating the threading of bobbin thread sequentially.
Figure 6B:
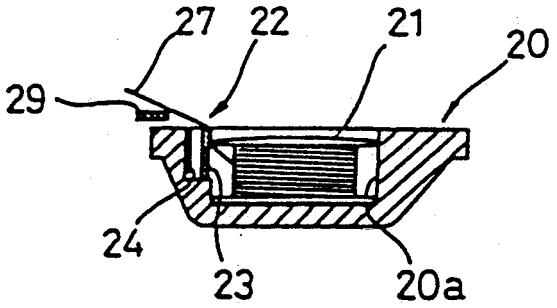
FIGS. 6B, 7B and 8B are longitudinal section views corresponding to FIGS. 6A, 7A, and 8A, respectively.
Figure 7A:
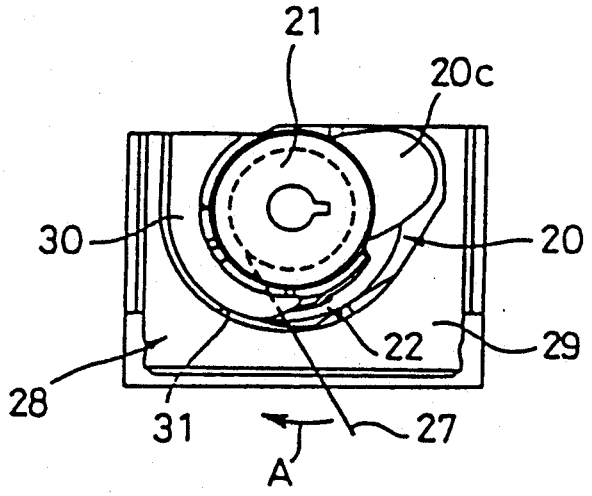
Figure 7B:
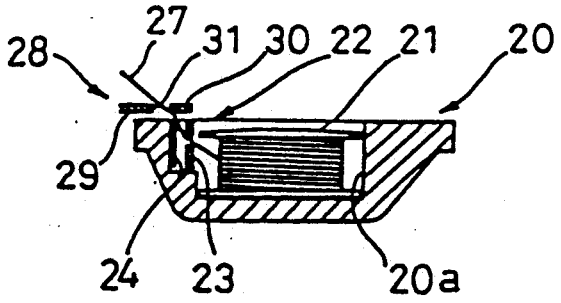

In operation, an operator inserts the bobbin 21 into the container 20*a* of the bobbin holder 20. As shown in FIGS. 6A and 6B, the tip of the bobbin thread 27 is drawn upward from the bobbin 21 and the cover 28. As shown in FIG. 6A, the operator pulls the bobbin thread 27 such that the bobbin thread 27 extends away from the slit 31 toward the outer periphery of the bobbin 21. Subsequently, the operator turns the tip of the bobbin thread 27 clockwise as shown by an arrow A in FIG. 6A, and the middle of the bobbin thread 27 starts entering the slit 31. Since the slit 31 is positioned above the outer periphery of the tension bracket 23 in the tension regulating portion 22, the bobbin thread 27 is pressed onto the upper edge of the tension bracket 23 between the bobbin 21 and the slit 31, and slides clockwise on the upper edge of the tension bracket 23. As shown in FIGS. 7A and 7B, the bobbin thread 27 is guided through the notch 23*b* in the tension bracket 23. Subsequently, as shown in FIGS. 8A and 8B, the bobbin thread 27 is passed from the notch 23*b* through the pore 23*a* and between the tension bracket 23 and the tension spring 24 toward the top of the cover 28. The tip of the bobbin thread 27 is then passed from the end of the slit 31 through the groove 32*a* of the thread trimmer 32 and is cut by the knife 32*b*.

As aforementioned, the bobbin thread 27 is inserted through the tension regulating portion 22. The length of the bobbin thread 27 drawn from the bobbin 21 becomes appropriate for sewing operation. Otherwise, if the length is too long, the bobbin thread 27 may be entangled with needle thread, and if too short, the rotary hook assembly cannot catch the bobbin thread 27.

Figure 9:
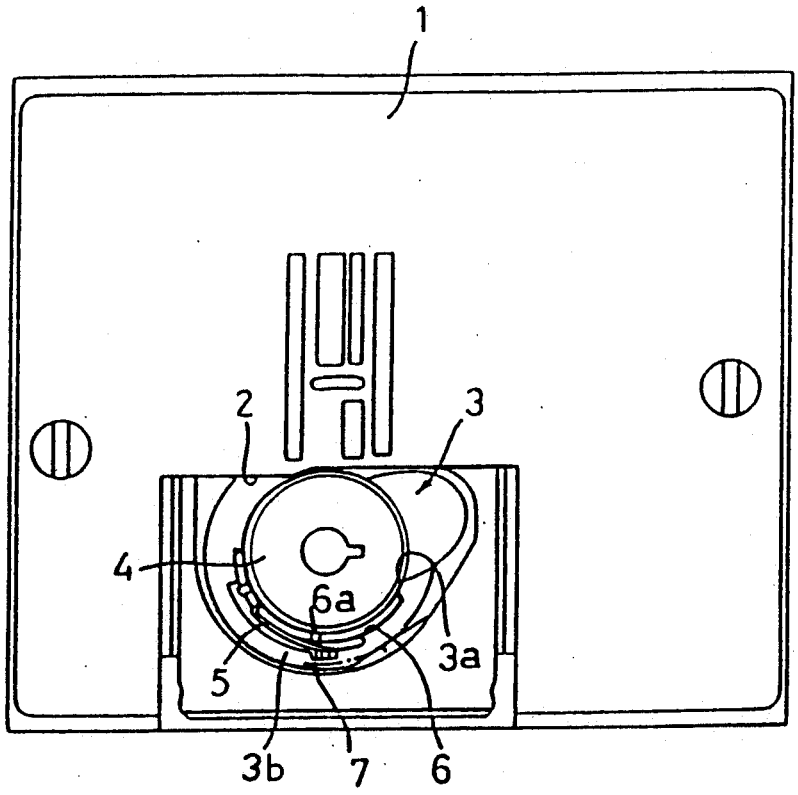
FIG. 9 RELATED ART
FIG. 9 is a plan view of a needle plate for the related art.

In this embodiment, when the operator passes the tip of the bobbin thread 27 drawn from the bobbin 21 through the slit 31 in the cover 28, the bobbin thread 27 can be passed through the tension regulating portion 22, between the tension bracket 23 and the tension spring 24. As compared with the related art shown in FIG. 9, where the operator should thread the tip of the bobbin thread through the notch 6*a* in the tension regulating portion 5 such that the tip is caught by the open end of the notch 6*a*, the tension regulating portion 22 can be more easily threaded. Consequently, the operator can easily set the bobbin thread 27 and securely start sewing operation without any trouble with the bobbin thread 27. In the embodiment, the thread trimmer 32 in the needle plate 16 can cut down the bobbin thread 27 drawn from the bobbin 21 to the required size.

This invention has been described above with reference to the preferred embodiment. Modifications and alterations may become apparent to one skilled in the art upon reading and understanding the specification. It is intended to include all such modifications and alterations within the scope of the appended claims. For example, in the embodiment the presser plate 29 and the arc plate 30 composes the cover 28, and the clearance between the presser plate 29 and the arc plate 30 forms the slit 31 in the cover 28. The cover 28 can be formed into a single piece of plate with a slit. The trimmer 32 is optional.

What is claimed is:

1. A bobbin thread supply device for a sewing machine, comprising:

a bobbin holder in an arm bed of the sewing machine;

a bobbin removably inserted into the bobbin holder;

tensioning means attached to a side wall of the bobbin holder for applying tension to a bobbin thread;

cover means for covering the bobbin holder; and guide means formed on the cover and along the side wall of the bobbin holder for guiding a bobbin thread extending from the bobbin into the tensioning means.

2. The bobbin thread supply device of claim 1, wherein the guide means comprises a slit formed in the cover means above the tensioning means.

3. The bobbin thread supply device of claim 2, wherein the slit comprises:

an arc-shaped first portion positioned adjacent an edge of the bobbin; and an arc-shaped second portion connected at a first end to the first portion.

4. The bobbin thread supply device of claim 3, wherein a second end of the second portion terminates in a bobbin thread cutting means for cutting the bobbin thread to a predetermined length.

5. The bobbin thread supply device of claim 1, wherein the tensioning means comprises:

a tension bracket attached to the inside wall of the bobbin holder; and a tension spring attached to the inside wall of the bobbin holder between the inside wall and the tension bracket; wherein the tension bracket and tension spring contact each other at a tension point; and a slot is formed on the tension bracket for guiding the bobbin thread to the tension point.

6. The bobbin thread supply device of claim 5, wherein:

a first end of the slot terminates at the tension point;

a second end of the slot terminates at an edge of the tension bracket; and the guide means guides the thread to the second end of the slot.

7. The bobbin thread supply device of claim 6, wherein a hole is formed at the first end of the slot for holding the bobbin thread at the tension point.

8. The bobbin thread supply device of claim 6, wherein the guide means comprises:

a slit formed in the cover having an arc-shaped first portion located adjacent an edge of the bobbin and an arc-shaped second portion connected at a first end to the first portion; wherein the point in the slit where the first portion is connected to the second portion is located above the second end of the slot.

9. A bobbin thread supply device for sewing machine, comprising:

a bobbin holder including a cavity formed in an arm bed of the sewing machine for receiving a bobbin; a bobbin removably inserted into the cavity, said bobbin having thread wrapped thereon;

tensioning means attached to an inside wall of the cavity for applying tension to the bobbin thread;

cover means for covering the bobbin holder; and guide means formed on the cover and along the inside wall of the cavity for guiding bobbin thread extended from the bobbin into the tensioning means; wherein the bobbin thread passes from the bobbin through the tensioning means and out of the guide means.

10. The bobbin thread supply device of claim 9, wherein the guide means comprises a slit formed in the cover means above the tensioning means.

11. The bobbin thread supply device of claim 10, wherein the slit comprises:

an arc-shaped first portion adjacent an edge of the bobbin; and an arc-shaped second portion connected at a first end to the first portion.

12. The bobbin thread supply device of claim 11, wherein the tensioning means comprises:

a tension bracket attached to the inside wall of the bobbin holder; and a tension spring attached to the inside wall of the bobbin holder between the inside wall and the tension bracket; wherein the tension bracket and tension spring contact each other at a tension point; and a slot formed on the tension bracket for guiding the bobbin thread to the tension point.

13. The bobbin thread supply device of claim 12, wherein a hole is formed at one end of the slot for holding the bobbin thread at the tension point and the other end of the slot terminates at an edge of the tension bracket.

14. The bobbin thread supply device of claim 12, wherein the point in the slit where the first portion is connected to the second portion is located above the end of the slot that terminates at the edge of the tension bracket.

15. The bobbin thread supply device of claim 14, wherein a second end of the second portion terminates in a bobbin thread cutting means for cutting the bobbin thread to a predetermined length.

16. A bobbin thread supply device for a sewing machine comprising:

a bobbin holder including a cavity formed in an arm bed of the sewing machine for receiving a bobbin;

a bobbin removably inserted into the cavity, said bobbin having thread wrapped thereon;

a tension bracket attached to an inside wall of the bobbin holder;

a tension spring attached to the inside wall of the bobbin holder between the inside wall and the tension bracket, where the tension bracket and tension spring contact each other at a tension point;

cover means for covering the bobbin holder;

a slit formed in the cover having an arc-shaped first portion adjacent an edge of the bobbin and an arc-shaped second second portion connected at a first end to the first portion, a second end of the second portion terminating in a bobbin thread cutting means for cutting the bobbin thread to a predetermined length; and a slot formed on the tension bracket having a hole formed at one end and terminating at another end at an edge of the tension bracket; wherein the point in the slit where the first portion is connected to the second portion is spaced from the end of the slot that terminates at the edge of the tension bracket; and the bobbin thread passes from the bobbin through the tensioning means and out of the slit.

17. A bobbin thread supply device for a sewing machine, comprising:

a bobbin holder in an arm bed of the sewing machine;

a bobbin removably inserted into the bobbin holder;

tensioning means attached to a side wall of the bobbin holder for applying tension to a bobbin thread;

cover means for covering the bobbin holder; and guide means formed on the cover and along the side wall of the bobbin holder for guiding a bobbin thread extended from the bobbin to the tensioning means, said guide means comprising as slit; wherein the slit comprises:

an arc-shaped first portion positioned adjacent an edge of the bobbin; and an arc-shaped second portion connected at a first end of the first portion.

* * * * *